US005693598A

United States Patent [19]

Abraham et al.

[11] Patent Number: 5,693,598

[45] Date of Patent: Dec. 2, 1997

[54] LOW-VISCOSITY LUBRICATING OIL AND FUNCTIONAL FLUID COMPOSITIONS

[75] Inventors: William D. Abraham, So. Euclid; Brent R. Dohner, Concord; John S. Manka, Euclid; Stephen H. Roby, Chesterland; James A. Supp, Parma, all of Ohio

[73] Assignee: The Lubrizol Corporation, Wickliffe, Ohio

[21] Appl. No.: 706,933

[22] Filed: Sep. 3, 1996

Related U.S. Application Data

[63] Continuation of Ser. No. 530,453, Sep. 19, 1995, abandoned.

[51] Int. Cl.[6] ..... C10M 135/18

[52] U.S. Cl. ..... 508/444; 508/404; 508/433; 508/438; 508/441; 508/424; 508/443

[58] Field of Search ..... 508/444, 443

[56] References Cited

U.S. PATENT DOCUMENTS

| | | | |
|---|---|---|---|
| 2,443,264 | 6/1948 | Mikeska | 252/46.6 |
| 2,471,115 | 5/1949 | Mikeska | 260/461 |
| 2,526,497 | 10/1950 | Mikeska | 252/46.6 |
| 2,591,577 | 4/1952 | McDermott | 252/46.6 |
| 3,687,848 | 8/1972 | Colclough | 252/46.6 |
| 3,770,854 | 11/1973 | Morris et al. | 252/46.6 |
| 3,833,496 | 9/1974 | Malec | 252/47.5 |
| 3,835,202 | 9/1974 | Elliott | 252/46.6 |
| 3,876,550 | 4/1975 | Holubec | 252/47.5 |
| 3,890,363 | 6/1975 | Malec | 252/47.5 |
| 4,263,150 | 4/1981 | Clason et al. | 252/32.7 |
| 4,289,635 | 9/1981 | Schroeck | 252/32.7 |
| 4,308,154 | 12/1981 | Clason et al. | 252/32.7 |
| 4,322,479 | 3/1982 | Forsberg | 428/471 |
| 4,417,990 | 11/1983 | Clason et al. | 252/32.7 |
| 4,501,678 | 2/1985 | Katayama et al. | 252/32.7 |
| 4,554,085 | 11/1985 | Zinbo et al. | 252/46.6 |
| 4,609,480 | 9/1986 | Hata et al. | 252/47.5 |
| 4,758,362 | 7/1988 | Butke | 252/47.5 |
| 5,034,141 | 7/1991 | Beltzer et al. | 252/32.7 |
| 5,034,142 | 7/1991 | Habeeb et al. | 252/32.7 |
| 5,158,698 | 10/1992 | Jolley et al. | 252/47.5 |
| 5,256,321 | 10/1993 | Todd | 252/32.007 |
| 5,342,531 | 8/1994 | Walters et al. | 252/46.6 |
| 5,569,405 | 10/1996 | Nakazato et al. | 508/192 |

*Primary Examiner*—Ellen M. McAvoy

*Attorney, Agent, or Firm*—William J. Connors; Fredrick D. Hunter

[57] ABSTRACT

This invention relates to a low-viscosity lubricating oil and functional fluid compositions, comprising: a major amount of an oil having a kinematic viscosity of up to about 4 cST at 100° C.; and a minor antiwear amount of (A) a compound represented by the formula $$R^1R^2N—C(X)S—(CR^3R^4)_aZ \quad \text{(A-I)}$$

wherein in Formula (A-I), $R^1$, $R^2$, $R^3$ and $R^4$ are independently hydrogen or hydrocarbyl groups, provided that at least one of $R^1$ and $R^2$ is a hydrocarbyl group; X is O or S; a is zero, 1 or 2; and Z is a hydrocarbyl group, a hetero group, a hydroxy hydrocarbyl group, an activating group, or a $—(S)_bC(X)—NR^1R^2$ group wherein b is zero, 1 or 2; provide that when a is 2, Z is an activating group; and when a is zero, Z can be an ammonium, amine or metal cation. In one embodiment this composition further comprises (B) a phosphorus compound.

29 Claims, No Drawings

LOW-VISCOSITY LUBRICATING OIL AND FUNCTIONAL FLUID COMPOSITIONS

This is a continuation of application Ser. No. 08/530,453 filed on Sep. 19, 1995, now abandoned.

TECHNICAL FIELD

This invention relates to low-viscosity lubricating oil and functional fluid compositions and, more particularly, to low-viscosity lubricating oil and functional compositions containing an effective amount of a thiocarbamate to provide such compositions with enhanced antiwear properties.

BACKGROUND OF THE INVENTION

The majority of engine lubricating oils that are sold worldwide have relatively high viscosities (e.g., SAE Viscosity Grades of 10W-30, 10W-40, 15W-40, etc.). These high viscosity oils are very useful for many applications. However, in order to improve fuel economy, it would be advantageous to employ lubricating oil compositions with lower viscosities (e.g., SAE Viscosity Grades of 5W-30, 5W-20, 0W-20, etc.). The problem with such low viscosity oils, however, is that they often do not exhibit sufficient antiwear properties to be deemed to be acceptable by industry standard tests for most engine lubricating oil uses. It would therefore be advantageous if an additive could be developed that provided such low viscosity oils with sufficient antiwear properties to be acceptable for such USES, For almost 40 years, the principal antiwear additive for engine lubricating oils has been zinc dialkyl dithiophosphate (ZDDP). However, ZDDP is typically used in the lubricating oil at a sufficient concentration to provide a phosphorus content of 0.12% by weight or higher in order to pass required industry standard tests for antiwear. Since phosphates may result in the deactivation of emission control catalysts used in automotive exhaust systems, a reduction in the amount of phosphorus-containing additives (e.g., ZDDP) in the oil would be desirable.

The problem, therefore, is to provide a low-viscosity lubricating oil composition that exhibits desired fuel economy characteristics and yet has acceptable antiwear properties and optionally has a reduced phosphorus level or is phosphorus free. This problem has been overcome with the present invention.

The use of polysulfides of thiophosphorus acids and thiophosphorus acid esters as additives for lubricants is disclosed in U.S. Pat. Nos. 2,443,264; 2,471,115; 2,526,497; and 2,591,577.

U.S. Pat. No. 3,770,854 discloses phosphorothionyl disulfides for use in lubricants as antioxidant, antiwear and extreme-pressure additives.

The use of metal salts of phosphorodithioic acids as additives for lubricants is disclosed in U.S. Pat. Nos. 4,263,150; 4,289,635; 4,308,154; 4,322,479; and 4,417,990. Amine salts of such acids are disclosed as being useful as additives for grease compositions in U.S. Pat. No. 5,256,321.

U.S. Pat. No. 4,501,678 discloses the use of an alkylthiocarbamoyl compound (e.g., bis(dibutylthiocarbamoyl) disulfide) in combination with a molybdenum compound (e.g., oxymolybdenum diisopropylphosphorodithioate sulfide) and a phosphorus ester (e.g., dibutyl hydrogen phosphite) in lubricants for improving fatigue life.

U.S. Pat. No. 4,758,362 discloses the addition of a carbamate to a low phosphorus or phosphorus free lubricating oil composition to provide such composition with enhanced extreme-pressure and antiwear properties.

U.S. Pat. No. 5,034,141 discloses that improved antiwear results can be obtained by combining a thiodixanthogen (e.g., octylthiodixanthogen) with a metal thiophosphate (e.g., ZDDP). U.S. Pat. No. 5,034,142 discloses the addition of a metal alkoxyalkylxanthate (e.g., nickel ethoxyethylxanthate), a dixanthogen (e.g., diethoxyethyl dixanthogen) and a metal thiophosphate (e.g., ZDDP) to a lubricant to improve antiwear.

SUMMARY OF THE INVENTION

This invention relates to a low-viscosity lubricating oil and functional fluid compositions, comprising: a major amount of an oil having a kinematic viscosity of up to about 4 cST at 100° C.; and a minor antiwear amount of (A) a compound represented by the formula $$R^1R^2N—C(X)S—(CR^3R^4)_aZ \qquad \text{(A-I)}$$

wherein in Formula (A-I), $R^1$, $R^2$, $R^3$ and $R^4$ are independently hydrogen or hydrocarbyl groups, provided that at least one of $R^1$ and $R^2$ is a hydrocarbyl group; X is O or S; a is zero, 1 or 2; and Z is a hydrocarbyl group, a hetero group, a hydroxy hydrocarbyl group, an activating group, or a $—(S)_bC(X)—NR^1R^2$ group wherein b is zero, 1 or 2; provide that when a is 2, Z is an activating group; and when a is zero, Z can be an ammonium, amine or metal cation. In one embodiment, this composition further comprises (B) a phosphorus compound. In one embodiment, the invention relates to a process comprising mixing the foregoing low-viscosity oil with component (A) and, optionally, component (B). Component (A) and optional component (B) provide the inventive compositions with enhanced antiwear properties and, in one embodiment, enhanced antioxidant properties.

DESCRIPTION OF THE PREFERRED EMBODIMENTS

As used in this specification and in the appended claims, the term "hydrocarbyl" denotes a group having a carbon atom directly attached to the remainder of the molecule and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms.

Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based," "aryl-based," and the like have meanings analogous to the above with respect to alkyl groups, aryl groups and the like.

The term "hydrocarbon-based" has the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about one gram per liter at 25° C.

The inventive lubricating oil and functional fluid compositions are useful in industrial applications and in automotive engines, transmissions and axles. These compositions are effective in a variety of applications including crankcase lubricating oils for spark-ignited and compression-ignited internal combustion engines, including automobile and truck engines, two-cycle engines, aviation piston engines, marine and low-load diesel engines, and the like. Also included are automatic transmission fluids, transaxle lubricants, gear lubricants, metalworking lubricants, hydraulic fluids, farm tractor fluids, and other lubricating oil and functional fluid compositions. The inventive compositions are particularly effective as engine lubricating oils.

In one embodiment the inventive lubricating oil and functional fluid compositions have an SAE Viscosity Grade of 0W, 0W-20, 0W-30, 0W-40, 0W-50, 0W-60, 5W, 5W-20, 5W-30, 5W-40, 5W-50 or 5W-60.

The Low-Viscosity Oil

The lubricating oil and functional fluid compositions of this invention are based on low-viscosity oils which are generally present in such compositions in a major amount (i.e. an amount greater than about 50% by weight). Generally, the low-viscosity oil is present in an amount greater than about 60%, or greater than about 70%, or greater than about 80% by weight of the lubricating oil or functional fluid composition. These low-viscosity oils have viscosities of up to about 4 cST at 100° C., and in one embodiment up to about 3.8 cST at 100° C., and in one embodiment up to about 3.5 cST at 100° C., and in one embodiment up to about 3 cST at 100° C. In one embodiment, the viscosity is in the range of about 1 to about 4 cST at 100° C., and in one embodiment about 1.5 to about 4 cST at 100° C., and in one embodiment about 2 to about 4 cST at 100° C., and in one embodiment about 2.5 to about 4 cST at 100° C., and in one embodiment about 3 to about 4 cST at 100° C. These oils can be natural, synthetic or mixtures thereof.

The natural oils that are useful include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale are also useful. Synthetic lubricating oils include hydrocarbon oils such as polymerized and interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, dinonylbenzenes, di-(2-ethylhexyl) benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two motes of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl) silicate, hexyl-(4-methyl-2-pentoxy) disiloxane, poly(methyl) siloxanes, poly-(methylphenyl) siloxanes, etc.). Other synthetic lubricating oils include liquid esters of phosphorus-containing acids (e.g., tricresyl phosphate, trioctyl phosphate, diethyl ester of decanephosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

(A) Thiocarbamate

Component (A) is a thiocarbamate which can be represented by the formula $$R^1R^2N—C(X)S—(CR^3R^4)_aZ \quad \text{(A-I)}$$

wherein in Formula (A-I), $R^1$, $R^2$, $R^3$ and $R^4$ are independently hydrogen or hydrocarbyl groups, provided that at least one of $R^1$ or $R^2$ is a hydrocarbyl group; X is O or S; a is zero, 1 or 2; and Z is a hydrocarbyl group, a hetero group (that is, a group attached through a heteroatom such as O, N, or S), a hydroxy hydrocarbyl group, an activating group, or a group represented by the formula $—(S)_bC(X)—NR^1R^2$ wherein b is zero, 1 or 2 and X is O or S. When a is zero, Z can be an ammonium, amine or metal cation.

When a is 2, Z is an activating group. In describing Z as an "activating group," what is meant is a group which will activate an olefin to which it is attached toward nucleophilic addition by, e.g., $CS_2$ or COS derived intermediates. (This is reflective of a method by which this material can be prepared, by reaction of an activated olefin with $CS_2$ and an amine.) The activating group Z can be, for instance, an ester group, typically but not necessarily a carboxylic ester group of the structure $—COOR^5$. It can also be an ester group based on a non-carbon acid, such as a sulfonic or sulfinic ester or a phosphonic or phosphinic ester. The activating group can also be any of the acids corresponding to the aforementioned esters. Z can also be an amide group, that is, based on the condensation of an acid group, preferably a carboxylic acid group, with an amine. In that case the $—(CR^3R^4)_aZ$ group can be derived from acrylamide. Z can also be an ether group, $—OR^5$; a carbonyl group, that is, an aldehyde or a ketone group; a cyano group, —CN, or an aryl group. In one embodiment Z is an ester group of the structure, $—COOR^5$, where $R^5$ is a hydrocarbyl group. $R^5$ can comprise 1 to about 18 carbon atoms, and in one embodiment 1 to about 6 carbon atoms. In one embodiment $R^5$ is methyl so that the activating group is $—COOCH_3$.

When a is 1, Z need not be an activating group, because the molecule is generally prepared by methods, described below, which do not involve nucleophilic addition to an activated double bond.

When Z is a hydrocarbyl or a hydroxy hydrocarbyl group, a can be zero, 1 or 2. These hydrocarbyl groups can have from 1 to about 30 carbon atoms, and in one embodiment 1 to about 18 carbon atoms, and in one embodiment 1 to about 12 carbon atoms. Examples include methyl, ethyl, propyl, n-butyl, isobutyl, pentyl, isopentyl, heptyl, octyl, 2-ethylhexyl, nonyl, decyl, dodecyl, and corresponding hydroxy-substituted hydrocarbyl groups such as hydroxymethyl, hydroxyethyl, hydroxypropyl, etc.

When a is zero, Z can be an ammonium, amine or metal cation. Thus the thiocarbamate (A), in one embodiment, can be represented by one of the formulae $$R^1R^2N—C(X)S^-{}^+NH_4 \quad \text{(A-II)}$$

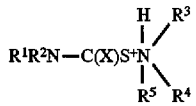

(A-III)

$$[R^1R^2N—C(X)S^-]_nM^n \quad \text{(A-IV)}$$

In Formulae (A-II), (A-III) and (A-IV), $R^1$, $R^2$ and X have the same meaning as in Formula (A-I). $R^3$, $R^4$ and $R^5$ are independently hydrogen or hydrocarbyl groups of 1 to about 30 carbon atoms. M is a metal cation and n is the valence of M.

When the thiocarbamate (A) is an ammonium salt (Formula (A-II), the salt is considered as being derived from ammonia ($NH_3$) or an ammonia yielding compound such as $NH_4OH$. Other ammonia yielding compounds will readily occur to those skilled in the art.

When the thiocarbamate (A) is an amine salt (Formula (A-III)), the salt may be considered as being derived from amines. The amines may be primary, secondary or tertiary amines, or mixtures thereof. Hydrocarbyl groups of the amines may be aliphatic, cycloaliphatic or aromatic. These include alkyl and alkenyl groups. In one embodiment the amine is an alkylamine wherein the alkyl group contains from 1 to about 24 carbon atoms. Any of the amines described below for making the phosphorus compound amine salts (B) can be used for making these thiocarbamate amine salts.

When the thiocarbamate (A) is a metal salt (Formula (A-IV)), M can be a Group IA, IIA or IIB metal, aluminum, lead, tin, iron, molybdenum, manganese, cobalt, nickel or bismuth. Zinc is an especially useful metal. Mixtures of two or more of these metals can be used. These salts can be neutral salts as shown in Formula (A-IV) or they can be basic salts wherein a stoichiometric excess of the metal is present.

$R^3$ and $R^4$ can be, independently, hydrogen or methyl or ethyl groups. When a is 2, at least one of $R^3$ and $R^4$ is normally hydrogen so that this compound will be $R^1R^2N—C(S)S—CR^3HCR^3R^4COOR^5$. In one embodiment the thiocarbamate is $R^1R^2N—C(S)S—CH_2CH_2COOCH_3$. (These materials can be derived from methyl methacrylate and methyl acrylate, respectively.) These and other materials containing appropriate activating groups are disclosed in greater detail in U.S. Pat. No. 4,758,362, which is incorporated herein by reference.

The substituents $R^1$ and $R^2$ on the nitrogen atom are likewise hydrogen or hydrocarbyl groups, but at least one should be a hydrocarbyl group. It is generally believed that at least one such hydrocarbyl group is desired in order to provide a measure of oil-solubility to the molecule. However, $R^1$ and $R^2$ can both be hydrogen, provided the other R groups in the molecule provide sufficient oil solubility to the molecule. In practice this means that at least one of the groups $R^3$ or $R^4$ should be a hydrocarbyl group of at least 4 carbon atoms. In one embodiment, $R^1$ and $R^2$ can be independently hydrocarbyl groups (e.g., aliphatic hydrocarbyl groups such as alkyl groups) of 1 to about 50 carbon atoms, and in one embodiment 1 to about 30 carbon atoms, and in one embodiment 1 to about 18 carbon atoms, and in one embodiment 1 to about 12 carbon atoms, and in one embodiment 1 to about 8 carbon atoms.

In one embodiment the thiocarbamate is a compound represented by the formula

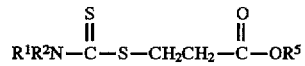

(A-V)

wherein in Formula (A-V) $R^1$, $R^2$ and $R^5$ are independently hydrocarbyl (e.g., alkyl) groups. These hydrocarbyl groups can have from 1 to about 18 carbon atoms, and in one embodiment 1 to about 12 carbon atoms, and in one embodiment 1 to about 8 carbon atoms, and in one embodiment 1 to about 4 carbon atoms. These compounds include S-carbomethoxyethyl-N,N-dibutyl dithiocarbamate which can be represented by the formula

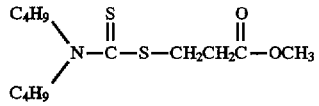

(A-VI)

Materials of this type can be prepared by a process described in U.S. Pat. No. 4,758,362. Briefly, these materials are prepared by reacting an amine, carbon disulfide or carbonyl sulfide, or source materials for these reactants, and a reactant containing an activated, ethylenically-unsaturated bond or derivatives thereof. These reactants are charged to a reactor and stirred, generally without heating, since the reaction is normally exothermic. Once the reaction reaches the temperature of the exotherm (typically 40°–65° C.), the reaction mixture is held at the temperature to insure complete reaction. After a reaction time of typically 3–5 hours, the volatile materials are removed under reduced pressure and the residue is filtered to yield the final product.

The relative amounts of the reactants used to prepare these compounds are not critical. The charge ratios to the reactor can vary where economics and the amount of the product desired are controlling factors. Thus, the molar charge ratio of the amine to the $CS_2$ or COS reactant to the ethylenically unsaturated reactant may vary in the ranges 5:1:1 to 1:5:1 to 1:1:5. In one embodiment, the charge ratios of these reactants is 1:1:1.

In the case where a is 1, the activating group Z is separated from the sulfur atom by a methylene group. Materials of this type can be prepared by reaction of sodium dithiocarbamate with a chlorine-substituted material. Such materials are described in greater detail in U.S. Pat. No. 2,897,152, which is incorporated herein by reference.

In one embodiment, a is zero, and Z is —C(S)—$NR^1R^2$, —SC(S)—$NR^1R^2$ or —SSC(S)—$NR^1R^2$. These compounds can be referred to as mono-, di- and trisulfides, respectively. These are known compounds which can be prepared using known procedures. For example, the disulfides can be made by oxidizing a thiocarbamate to form the desired disulfide. Examples of useful oxidizing agents that can be used include hydrogen peroxide, cobalt maleonitriledithioate, $K_2Fe(CN)_6$, $FeCl_3$, dimethylsulfoxide, dithiobis(thio formate), copper sulfate, etc.

In one embodiment the thiocarbamate (A) is a disulfide represented by the formula

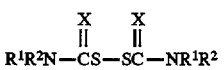

(A-VII)

wherein in Formula (A-VII), $R^1$ and $R^2$ are independently hydrocarbyl groups, and X is O or S, and in one embodiment X is S. These include compounds represented by the formula

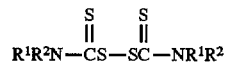

(A-VIII)

wherein in Formula (A-VII) and (A-VIII), $R^1$ and $R^2$ are independently hydrocarbyl groups including aliphatic hydrocarbyl groups such as alkyl groups. These hydrocarbyl groups may be linear (straight chain) or branched chain and can have 1 to about 50 carbon atoms, and in one embodiment 1 to about 30 carbon atoms, and in one embodiment 1 to about 18 carbon atoms, and in one embodiment 1 to about 12 carbon atoms, and in one embodiment 1 to about 8 carbon atoms. Typical hydrocarbyl groups include, for example, methyl, ethyl, propyl, n-butyl, isobutyl, pentyl, isopentyl, heptyl, octyl, 2-ethylhexyl, nonyl, decyl, and dodecyl, Typical examples of the thiocarbamate disulfide compounds include bis(dimethylthiocarbamoyl)disulfide, bis(dibutylthiocarbamoyl)disulfide, bis(diamylthiocarbamoyl)disulfide, bis(dioctylthiocarbamoyl)disulfide, etc.

In one embodiment, component (A) is employed in the inventive lubricating oil or functional fluid composition at a concentration sufficient to provide such composition with enhanced antiwear properties, and in one embodiment enhanced antioxidant properties. The concentration is generally in the range of about 0.01% to about 2%, and in one embodiment about 0.1% to about 1%, and in one embodiment about 0.1% to about 0.8%, and in one embodiment about 0.1% to about 0.5% by weight based on the total weight of the lubricating oil or functional fluid.

The following examples illustrate the preparation of thiocarbamates (A) that can be used with this invention. In the following example as well as throughout the specification and in the claims, unless otherwise indicated, all parts and percentages are by weight, all temperatures are in degrees Celsius, and all pressures are atmospheric,

EXAMPLE A-1

Carbon disulfide (79.8 grams, 1.05 moles) and methyl acrylate (86 grams, 1.0 mole) are placed in a reactor and stirred at room temperature. Di-n-butylamine (129 grams, 1.0 mole) is added dropwise to the mixture. The resulting reaction is exothermic, and the di-n-butylamine addition is done at a sufficient rate to maintain the temperature at 55° C. After the addition of di-n-butylamine is complete, the reaction mixture is maintained at 55° C. for four hours. The mixture is blown with nitrogen at 85° C. for one hour to remove unreacted starting material. The reaction mixture is filtered through filter paper, and the resulting product is a viscous orange liquid.

EXAMPLE A-2

Di-n-butylamine (129 grams, 1 mole) is charged to a reactor. Carbon disulfide (84 grams, 1.1 moles) is added dropwise over a period of 2.5 hours. The resulting reaction is exothermic but the temperature of the reaction mixture is maintained below 50° C. using an ice bath. After the addition of carbon disulfide is complete the mixture is maintained at room temperature for one hour with stirring. A 50% aqueous sodium hydroxide solution (40 grams) is added and the resulting mixture is stirred for one hour. A 30% aqueous hydrogen peroxide solution (200 grams) is added dropwise. The resulting reaction is exothermic but the temperature of the reaction mixture is maintained below 50° C. using an ice bath. The mixture is transferred to a separatory funnel. Toluene (800 grams) is added to the mixture. An organic layer is separated from the product and washed with one liter of distilled water. The separated and washed organic layer is dried over sodium carbonate and filtered through diatomaceous earth. The mixture is stripped on a rotary evaporator at 77° C. and 20 mm Hg to provide the desired dithiocarbamate disulfide product which is in the form of a dark orange liquid.

(B) Phosphorus Compound

The phosphorus compound (B) is an optional ingredient, but when present can be a phosphorus acid, ester or derivative thereof. These include phosphorus acid, phosphorus acid ester, phosphorus acid salt, or derivative thereof. The phosphorus acids include the phosphoric, phosphonic, phosphinic and thiophosphoric acids including dithiophosphoric acid as well as the monothiophosphoric, thiophosphinic and thiophosphonic acids.

The phosphorus compound (B) can be a phosphorus acid ester derived from a phosphorus acid or anhydride and an alcohol of 1 to about 50 carbon atoms, and in one embodiment 1 to about 30 carbon atoms. It can be a phosphite, a monothiophosphate, a dithiophosphate, or a dialkylthiophosphoryl disulfide. It can also be a metal, amine or ammonium salt of a phosphorus acid or phosphorus acid ester. It can be a phosphorus containing amide or a phosphorus-containing carboxylic ester.

The phosphorus compound can be a phosphate, phosphonate, phosphinate or phosphine oxide. These compounds can be represented by the formula

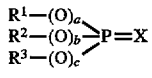

(B-I)

wherein in Formula (B-I), $R^1$, $R^2$ and $R^3$ are independently hydrogen or hydrocarbyl groups, X is O or S, and a, b and c are independently zero or 1.

The phosphorus compound can be a phosphite, phosphonite, phosphinite or phosphine. These compounds can be represented by the formula

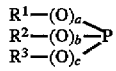

(B-II)

wherein in Formula (B-II), $R^1$, $R^2$ and $R^3$ are independently hydrogen or hydrocarbyl groups, and a, b and c are independently zero or 1.

The total number of carbon atoms in $R^1$, $R^2$ and $R^3$ in each of the above Formulae (B-I) and (B-II) must be sufficient to render the compound soluble in the low-viscosity oil used in formulating the inventive compositions. Generally, the total number of carbon atoms in $R^1$, $R^2$ and $R^3$ is at least about 8, and in one embodiment at least about 12, and in one embodiment at least about 16. There is no limit to the total number of carbon atoms in $R^1$, $R^2$ and $R^3$ that is required, but a practical upper limit is about 400 or about 500 carbon atoms. In one embodiment, $R^1$, $R^2$ and $R^3$ in each of the above formulae are independently hydrocarbyl groups of 1 to about 100 carbon atoms, or 1 to about 50 carbon atoms, or 1 to about 30 carbon atoms, with the proviso that the total number of carbons is at least about 8. Each $R^1$, $R^2$ and $R^3$ can be the same as the other, although they may be different. Examples of useful $R^1$, $R^2$ and $R^3$ groups include isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and the like.

The phosphorus compounds represented by Formulae (B-I) and (B-II) can be prepared by reacting a phosphorus acid or anhydride with an alcohol or mixture of alcohols corresponding to $R^1$, $R^2$ and $R^1$ in Formulae (B-I) and (B-II). The phosphorus acid or anhydride is generally an inorganic phosphorus reagent such as phosphorus pentoxide, phosphorus trioxide, phosphorus tetraoxide, phosphorus acid, phosphorus halide, or lower phosphorus esters, and the like. Lower phosphorus acid esters contain from 1 to about 7 carbon atoms in each ester group. The phosphorus acid ester may be a mono, di- or triphosphoric acid ester.

The phosphorus compound (B) can be a compound represented by the formula

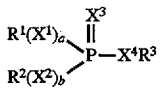

(B-III)

wherein in Formula (B-III): $X^1$, $X^2$, $X^3$ and $X^4$ are independently oxygen or sulfur, and $X^1$ and $X^2$ can be $NR^4$; a and b are independently zero or one; $R^1$, $R^2$ $R^3$ and $R^4$ are independently hydrocarbyl groups, and $R^3$ and $R^4$ can be hydrogen.

Useful phosphorus compounds of the type represented by Formula (B-III) are phosphorus- and sulfur-containing compounds. These include those compounds wherein at least one $X^3$ or $X^4$ is sulfur, and in one embodiment both $X^3$ and $X^4$ are sulfur, at least one $X^1$ or $X^2$ is oxygen or sulfur, and in one embodiment both $X^1$ and $X^2$ are oxygen, a and b are each 1, and $R^3$ is hydrogen. Mixtures of these compounds may be employed in accordance with this invention.

In Formula (B-III), $R^1$ and $R^2$ are independently hydrocarbyl groups that are preferably free from acetylenic unsaturation and usually also from ethylenic unsaturation and in one embodiment have from about 1 to about 50 carbon atoms, and in one embodiment from about 1 to about 30 carbon atoms, and in one embodiment from about 1 to about 18 carbon atoms, and in one embodiment from about 1 to about 8 carbon atoms. Each $R^1$ and $R^2$ can be the same as the other, although they may be different and either or both may be mixtures. Examples of $R^1$ and $R^2$ groups include isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and mixtures thereof. Particular examples of useful mixtures include, for example, isopropyl/n-butyl; isopropyl/secondarybutyl; isopropyl/4-methyl-2-pentyl; isopropyl/2-ethyl-1-hexyl; isopropyl/isooctyl; isopropyl/decyl; isopropyl/dodecyl; and isopropyl/tridecyl.

In Formula (B-III), $R^3$ and $R^4$ are independently hydrogen or hydrocarbyl groups (e.g. alkyl) of 1 to about 12 carbon atoms, and in one embodiment 1 to about 4 carbon atoms. $R^3$ is preferably hydrogen.

Phosphorus compounds corresponding to Formula (B-III) wherein $X^3$ and $X^4$ are sulfur can be obtained by the reaction of phosphorus pentasulfide ($P_2S_5$) and an alcohol or mixture of alcohols corresponding to $R^1$ and $R^2$. The reaction involves mixing at a temperature of about 20° C. to about 200° C., four moles of alcohol with one mole of phosphorus pentasulfide. Hydrogen sulfide is liberated in this reaction. The oxygen-containing analogs of these compounds can be prepared by treating the dithioic acid with water or steam which, in effect, replaces one or both of the sulfur atoms.

The phosphorus compound (B) can be a compound represented by the formula

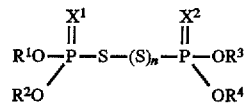

(B-IV)

wherein in Formula (B-IV), $R^1$, $R^2$, $R^3$ and $R^1$ are independently hydrocarbyl groups, $X^1$ and $X^2$ are independently O or S, and n is zero to 3. In one embodiment $X^1$ and $X^2$ are each S, and n is 1. $R^1$, $R^2$, $R^3$ and $R^4$ are independently hydrocarbyl groups that are preferably free from acetylenic unsaturation and usually also free from ethylenic unsaturation. In one embodiment $R^1$, $R^2$, $R^3$ and $R^4$ independently have from about 1 to about 50 carbon atoms, and in one embodiment from about 1 to about 30 carbon atoms, and in one embodiment from about 1 to about 18 carbon atoms, and in one embodiment from about 1 to about 8 carbon atoms. Each $R^1$, $R^2$, $R^3$ and $R^4$ can be the same as the other, although they may be different and mixtures may be used. Examples of $R^1$, $R^2$, $R^3$ and $R^4$ groups include isopropyl, butyl, n-butyl, isobutyl, amyl, 4-methyl-2-pentyl, octyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and mixtures thereof.

The compounds represented by Formula (B-IV) can be prepared by first reacting an alcohol, phenol or aliphatic or aromatic mercaptan with a sulfide of phosphorus, such as $P_2S_3$, $P_2S_5$, $P_4S_3$, $P_4S_7$, $P_4S_{10}$, and the like, to form a partially esterified thiophosphorus or thiophosphoric acid, and then further reacting this product as such or in the form of a metal salt with an oxidizing agent or with a sulfur halide. Thus, when an alcohol is reacted with phosphorus trisulfide, a dialkylated monothiophosphorus acid is formed according to the following equation:

$$4ROH+P_2S_3 \rightarrow 2(RO)_2PSH+H_2S$$

This alkylated thiophosphorus acid may then be treated with an oxidizing agent or with sulfur dichloride or sulfur monochloride to form a disulfide, trisulfide, or tetrasulfide, respectively, according to the following equations:

$$4(RO)_2PSH+O_2 \rightarrow 2(RO)_2P—S—S—P(OR)_2+2H_2O$$

$$2(RO)_2PSH+SCl_2 \rightarrow (RO)_2P—S—S—S—P(OR)_2+2HCl$$

$$2(RO)_2PSH+S_2Cl_2 \rightarrow (RO)_2P—S—(S)_2—S—P—(OR)_2+2HCl$$

Similarly, when the alcohol is reacted with phosphorus pentasulfide, the corresponding di-substituted dithiophosphoric acid will be formed, and this may likewise be converted into disulfide, trisulfide or tetrasulfide compounds. Suitable alcohols such as those discussed below may be employed. Sulfurized alcohols such as sulfurized oleyl alcohol may also be used. Corresponding reactions take place by starting with mercaptans, phenols or thiophenols instead of alcohols. Suitable oxidizing agents for converting the thiophosphorus and thiophosphoric acids to disulfides include iodine, potassium triodide, ferric chloride, sodium hypochlorite, hydrogen peroxide, oxygen, etc.

Alcohols used to prepare the phosphorus compounds of Formulae (B-I), (B-II), (B-III) and (B-IV) include isopropyl, n-butyl, isobutyl, amyl, 4-methyl-2-pentyl, hexyl, isooctyl, decyl, dodecyl, tetradecyl, 2-pentenyl, dodecenyl, and aromatic alcohols such as the phenols, etc. Higher synthetic monohydric alcohols of the type formed by Oxo process (e.g., 2-ethylhexyl), the Aldol condensation, or by organoaluminum catalyzed oligomerization of alpha-olefins (especially ethylene), followed by oxidation and hydrolysis, also are useful. Examples of useful monohydric alcohols and alcohol mixtures include the commercially available "Alfol" alcohols marketed by Continental Oil Corporation. Alfol 810 is a mixture of alcohols containing primarily straight chain, primary alcohols having from 8 to 10 carbon atoms. Alfol 12 is a mixture of alcohols containing mostly $C_{12}$ fatty alcohols. Alfol 1218 is a mixture of synthetic, primary, straight-chain alcohols containing primarily 12 to 18 carbon atoms. The Alfol 20+ alcohols are mixtures of $C_{18}$–$C_{28}$ primary alcohols having mostly, on an alcohol basis, $C_{20}$ alcohols as determined by GLC (gas-liquid-chromatography). The Alfol 22+ alcohols are $C_{18}$–$C_{28}$ primary alcohols containing primarily, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Adol 60 which comprises about 75% by weight of a straight chain $C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Proctor & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

Examples of useful phosphorus acid esters include the phosphoric acid esters prepared by reacting a phosphoric acid or anhydride with cresol alcohols. An example is tricresyl phosphate.

The following examples illustrate the preparation of phosphorus compounds (B) that are useful with this invention.

EXAMPLE B-1

A phosphorodithoic acid derived from $P_2S_5$ and an alcohol mixture of 40% by weight isopropyl alcohol and 60% by weight 4-methyl-secondary-amyl alcohol (4518 grams, 14.34 equivalents) is charged to a reactor. A 30% aqueous hydrogen peroxide solution (1130 grams, 10.0 equivalents) is added dropwise at a rate of 7.3 grams per minute. The temperature of the reaction mixture increases from 24° C. to 38° C. A 50% aqueous sodium hydroxide solution (40 grams, 0.50 equivalents) is added. The reaction mixture is stirred for 5 minutes, and then allowed to stand. The mixture separates into two layers. The aqueous layer contains water, phosphorodithioic acid salt and excess alcohol from the phosphorodithioic acid. The organic layer contains the desired product. The top water layer is drawn off (1108 grams) and the remaining organic portion is stripped at 100° C. and 20 mm Hg for two hours. The stripped organic product is filtered using filter aid to provide the desired product which is a phosphorus-containing disulfide in the form of a clear yellow liquid (4060 grams).

EXAMPLE B-2

Di-(methylamyl) phosphorodithioic acid (1202 grams, 3.29 equivalents) is charged to a reactor. A 30% aqueous hydrogen peroxide solution (319 grams, 2.82 moles) is added dropwise at a rate of 7.3 grams per minute. The temperature of the reaction mixture increases from 24° C. to 38° C. A 50% aqueous sodium hydroxide solution (12 grams, 0.15 equivalents) is added. The reaction mixture is stirred for 5 minutes, and then allowed to stand. The mixture separates into two layers. The aqueous layer contains water, phosphorodithioic acid salt and excess methylamyl alcohol from the phosphorodithioic acid. The organic layer contains the desired product. The bottom water layer is drawn off and the remaining organic portion is stripped at 100° C. and 20 mm Hg for two hours. The stripped organic product is filtered using filter aid to provide the desired phosphorus-containing disulfide product which is a clear yellow liquid (1016 grams).

EXAMPLE B-3

Di-(isooctyl)phosphorodithioic acid (991 grams, 2.6 equivalents) and a phosphorodithioic acid derived from $P_2S_5$ and an alcohol mixture consisting of 65% isobutyl alcohol and 35% amyl alcohol (298 grams, 1.0 equivalent) are charged to a reactor. A 30% aqueous hydrogen peroxide solution (294 grams, 2.6 moles) is added dropwise over a period of 1.5 hours. The resulting reaction is exothermic but the temperature of the reaction is maintained at 15°–30° C. using a dry ice bath. After the addition of the hydrogen peroxide is complete the reaction mixture is maintained at room temperature for 2 hours. The mixture is transferred to a separatory funnel and toluene (800 grams) is added. An organic layer is separated. The organic layer is washed with a 50% aqueous sodium hydroxide solution (800 grams) and then washed with one liter of distilled water. The organic layer is dried over $MgSO_4$ and filtered through a glass fritted funnel. The mixture is stripped on a rotary evaporator at 77° C. and 20 mm Hg to provide the desired product which is in the form of a yellow liquid.

In one embodiment, the phosphorus compound (B) is a monothiophosphoric acid ester or a monothiophosphate. Monothiophosphates are prepared by the reaction of a sulfur source and a dihydrocarbyl phosphite. The sulfur source may be elemental sulfur, a sulfide, such as a sulfur coupled olefin or a sulfur coupled dithiophosphate. Elemental sulfur is a useful sulfur source. The preparation of monothiophosphates is disclosed in U.S. Pat. No. 4,755,311 and PCT Publication WO 87/07638 which are incorporated herein by reference for their disclosure of monothiophosphates, sulfur sources for preparing monothiophosphates and the process for making monothiophosphates.

Monothiophosphates may also be formed in the lubricant blend or functional fluid by adding a dihydrocarbyl phosphite to a lubricating oil composition or functional fluid containing a sulfur source. The phosphite may react with the sulfur source under blending conditions (i.e., temperatures from about 30° C. to about 100° C. or higher) to form the monothiophosphate.

In one embodiment, the phosphorus compound (B) is a dithiophosphoric acid or phosphorodithioic acid. The dithiophosphoric acid can be reacted with an epoxide or a glycol to form an intermediate. The intermediate is then reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is useful. The glycols may be aliphatic glycols having from 1 to about 12, and in one embodiment about 2 to about 6, and in one embodiment 2 or 3 carbon atoms, or aromatic glycols. Aliphatic glycols include ethylene glycol, propylene glycol, triethylene glycol and the like. Aromatic glycols include hydroquinone, catechol, resorcinol, and the like. These are described in U.S. Pat. No. 3,197,405 which is incorporated herein by reference for its disclosure of dithiophosphoric acids, glycols, epoxides, inorganic phosphorus reagents and methods of reacting the same.

In one embodiment the phosphorus compound (B) is a phosphite. The phosphite can be a di- or trihydrocarbyl phosphite. Each hydrocarbyl group can have from 1 to about 24 carbon atoms, or from 1 to about 18 carbon atoms, or from about 2 to about 8 carbon atoms. Each hydrocarbyl group may be independently alkyl, alkenyl or aryl. When the hydrocarbyl group is an aryl group, then it contains at least about 6 carbon atoms; and in one embodiment about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. In one embodiment each hydrocarbyl group is independently propyl, butyl, pentyl, hexyl, heptyl, oleyl or phenyl, more preferably butyl, oleyl or phenyl and more preferably butyl or oleyl. Phosphites and their preparation are known and many phosphites are available commercially. Useful phosphites include dibutylhydrogen phosphite, trioleyl phosphite and triphenyl phosphite.

In one embodiment, the phosphorus compound (B) is a phosphorus-containing amide. The phosphorus-containing amides may be prepared by the reaction of a phosphorus acid (e.g., a dithiophosphoric acid as described above) with an unsaturated amide. Examples of unsaturated amides include acrylamide, N,N'-methylenebisacrylamide, methacrylamide, crotonamide, and the like. The reaction product of the phosphorus acid with the unsaturated amide may be further reacted with linking or coupling compounds, such as formaldehyde or paraformaldehyde to form coupled compounds. The phosphorus-containing amides are known in the art and are disclosed in U.S. Pat. Nos. 4,876,374, 4,770,807 and 4,670,169 which are incorporated by reference for their disclosures of phosphorus amides and their preparation.

in one embodiment, the phosphorus compound (B) is a phosphorus-containing carboxylic ester. The phosphorus-containing carboxylic esters may be prepared by reaction of one of the above-described phosphorus acids, such as a dithiophosphoric acid, and an unsaturated carboxylic acid or ester, such as a vinyl or allyl acid or ester. If the carboxylic acid is used, the ester may then be formed by subsequent reaction with an alcohol.

The vinyl ester of a carboxylic acid may be represented by the formula $RCH{=}CH{-}O(O)CR^1$ wherein R is a hydrogen or hydrocarbyl group having from 1 to about 30 carbon atoms, preferably hydrogen or a hydrocarbyl group having 1 to about 12, more preferably hydrogen, and $R^1$ is a hydrocarbyl group having 1 to about 30 carbon atoms, preferably 1 to about 12, more preferably 1 to about 8. Examples of vinyl esters include vinyl acetate, vinyl 2-ethylhexanoate, vinyl butanoate, and vinyl crotonate.

In one embodiment, the unsaturated carboxylic ester is an ester of an unsaturated carboxylic acid, such as maleic, fumaric, acrylic, methacrylic, itaconic, citraconic acids and the like. The ester can be represented by the formula RO—(O)C—HC=CH—C(O)OR wherein each R is independently a hydrocarbyl group having 1 to about 18 carbon atoms, or 1 to about 12, or 1 to about 8 carbon atoms. Examples of unsaturated carboxylic esters that are useful include methylacrylate, ethylacrylate, 2-ethylhexylacrylate, 2-hydroxyethylacrylate, ethylmethacrylate, 2-hydroxyethylmethacrylate, 2-hydroxypropylmethacrylate, 2-hydroxypropylacrylate, ethylmaleate, butylmaleate and 2-ethylhexylmaleate. The above list includes mono- as well as diesters of maleic, fumaric and citraconic acids.

In one embodiment, the phosphorus compound (B) is the reaction product of a phosphorus acid and a vinyl ether. The vinyl ether is represented by the formula $R—CH_2=CH—OR^1$ wherein R is hydrogen or a hydrocarbyl group having 1 to about 30, preferably 1 to about 24, more preferably 1 to about 12 carbon atoms, and $R^1$ is a hydrocarbyl group having 1 to about 30 carbon atoms, preferably 1 to about 24, more preferably 1 to about 12 carbon atoms. Examples of vinyl ethers include methyl vinylether, propyl vinylether, 2-ethylhexyl vinylether and the like.

When the phosphorus compound (B) is acidic, it may be reacted with ammonia or a source of ammonia, an amine, or metallic base to form the corresponding salt. The salts may be formed separately and then added to the lubricating oil or functional fluid composition. Alternatively, the salts may be formed when the acidic phosphorus compound (B) is blended with other components to form the lubricating oil or functional fluid composition. The phosphorus compound can then form salts with basic materials which are in the lubricating oil or functional fluid composition such as basic nitrogen containing compounds (e.g., carboxylic dispersants) and overbased materials.

The metal salts which are useful with this invention include those salts containing Group IA, IIA or IIB metals, aluminum, lead, tin, iron, molybdenum, manganese, cobalt, nickel or bismuth. Zinc is an especially useful metal. These salts can be neutral salts or basic salts. Examples of useful metal salts of phosphorus-containing acids, and methods for preparing such salts are found in the prior art such as U.S. Pat. Nos. 4,263,150, 4,289,635; 4,308,154; 4,322,479; 4,417,990; and 4,466,895, and the disclosures of these patents are hereby incorporated by reference. These salts include the Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The following examples illustrate the preparation of useful metal salts of the phosphorus compounds (B).

EXAMPLE B-4

A phosphorodithioic acid is prepared by reacting finely powdered phosphorus pentasulfide (4.37 moles) with an alcohol mixture containing 11.53 moles of isopropyl alcohol and 7.69 moles of isooctanol. The phosphorodithioic acid obtained in this manner has an acid number of about 178–186 and contains 10.0% phosphorus and 21.0% sulfur. This phosphorodithioic acid is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorus, 18.5% sulfur and 9.5% zinc.

EXAMPLE B-5

(a) A phosphorodithioic acid is prepared by reacting a mixture of 1560 parts (12 moles) of isooctyl alcohol and 180 parts (3 moles) of isopropyl alcohol with 756 parts (3.4 moles) of phosphorus pentasulfide. The reaction is conducted by heating the alcohol mixture to about 55° C. and thereafter adding the phosphorus pentasulfide over a period of 1.5 hours while maintaining the reaction temperature at about 60°–75° C. After all of the phosphorus pentasulfide is added, the mixture is heated and stirred for an additional hour at 70°–75° C., and thereafter filtered through filter aid.

(b) Zinc oxide (282 parts, 6.87 moles) is charged to a reactor with 278 parts of mineral oil. The phosphorodithioic acid prepared in (a) (2305 parts, 6.28 moles) is charged to the zinc oxide slurry over a period of 30 minutes with an exotherm to 60° C. The mixture then is heated to 80° C. and maintained at this temperature for 3 hours. After stripping to 100° C. and 6 mm Hg, the mixture is filtered twice through filter aid, and the filtrate is the desired oil solution of the zinc salt containing 10% oil, 7.97% zinc; 7.21% phosphorus; and 15.64% sulfur.

EXAMPLE B-6

(a) Isopropyl alcohol (396 parts, 6.6 moles) and 1287 parts (9.9 moles) of isooctyl alcohol are charged to a reactor and heated with stirring to 59° C. Phosphorus pentasulfide (833 parts, 3.75 moles) is then added under a nitrogen sweep. The addition of the phosphorus pentasulfide is completed in about 2 hours at a reaction temperature between 59°–63° C. The mixture then is stirred at 45°–63° C. for about 1.45 hours and filtered. The filtrate is the desired phosphorodithioic acid.

(b) A reactor is charged with 312 parts (7.7 equivalents) of zinc oxide and 580 parts of mineral oil. While stirring at room temperature, the phosphorodithioic acid prepared in (a) (2287 parts, 6.97 equivalents) is added over a period of about 1.26 hours with an exotherm to 54° C. The mixture is heated to 78° C. and maintained at 78°–85° C. for 3 hours. The reaction mixture is vacuum stripped to 100° C. at 19 mm.Hg. The residue is filtered through a filter aid, and the filtrate is an oil solution (19.2% oil) of the desired zinc salt containing 7.86% zinc, 7.76% phosphorus and 14.8% sulfur.

EXAMPLE B-7

The general procedure of Example B-6 is repeated except that the mole ratio of isopropyl alcohol to isooctyl alcohol is 1:1. The product obtained in this manner is an oil solution (10% oil) of the zinc phosphorodithioate containing 8.96% zinc, 8.49% phosphorus and 18.05% sulfur.

EXAMPLE B-8

(a) A mixture of 420 parts (7 moles) of isopropyl alcohol and 518 parts (7 moles) of n-butyl alcohol is prepared and heated to 60° C. under a nitrogen atmosphere. Phosphorus pentasulfide (647 parts, 2.91 moles) is added over a period of one hour while maintaining the temperature at 65°–77° C. The mixture is stirred an additional hour while cooling. The material is filtered through filter aid, and the filtrate is the desired phosphorodithioic acid.

(b) A mixture of 113 parts (2.76 equivalents) of zinc oxide and 82 parts of mineral oil is prepared and 662 parts of the phosphorodithioic acid prepared in (a) are added over a period of 20 minutes. The reaction is exothermic and the temperature of the mixture reaches 70° C. The mixture then is heated to 90° C. and maintained at this temperature for 3 hours. The reaction mixture is stripped to 105° C. and 20 mm Hg. The residue is filtered through filter aid, and the filtrate is the desired product containing 10.17% phosphorus, 21.0% sulfur and 10.98% zinc.

EXAMPLE B-9

A mixture of 29.3 parts (1.1 equivalents) of ferric oxide and 33 parts of mineral oil is prepared, and 273 parts (1.0 equivalent) of the phosphorodithioic acid prepared in Example B-7(a) are added over a period of 2 hours. The reaction is exothermic during the addition, and the mixture is thereafter stirred an additional 3.5 hours while maintaining the mixture at 70° C. The product is stripped to 105° C./10 mm.Hg. and filtered through filter aid. The filtrate is a black-green liquid containing 4.9% iron and 10.0% phosphorus.

EXAMPLE B-10

A mixture of 239 parts (0.41 mole) of the product of Example A-5(a), 11 parts (0.15 mole) of calcium hydroxide and 10 parts of water is heated to about 80° C. and maintained at this temperature for 6 hours. The product is stripped to 105° C./10 mm Hg and filtered through a filter aid. The filtrate is a molasses-colored liquid containing 2.19% calcium.

EXAMPLE B-11

(a) A mixture of 105.6 grams (1.76 moles) of isopropyl alcohol and 269.3 grams (2.64 moles) of 4-methyl-2-pentanol is prepared and heated to 70° C. Phosphorus pentasulfide (222 grams, 1 mole) is added to the alcohol mixture while maintaining the temperature at 70° C. One mole of hydrogen sulfide is liberated. The mixture is maintained at 70° C. for an additional four hours. The mixture is filtered through diatomaceous earth to yield a liquid green product having an acid number in the range of 179–189.

(b) 44.6 grams (1.09 equivalents) of ZnO are added to diluent oil to form a slurry. One equivalent (based upon the measured acid number) of the phosphorodithioic acid prepared in (a) are added dropwise to the ZnO slurry. The reaction is exothermic. The reaction mixture is stripped to 100° C. and 20 mm Hg to remove water of reaction and excess alcohol. The residue is filtered through diatomaceous earth. The filtrate, which is a viscous liquid, is diluted with diluent oil to provide a final product having a 9.5% by weight phosphorus content.

EXAMPLE B-12

A mixture of the product of Example B-11 (a) (184 grams, 0.6 equivalents) and Example B-11 (b) (130 grams, 0.4 equivalents) is placed in a reactor. A 34% aqueous hydrogen peroxide solution (80 grams, 0.8 moles) is added dropwise. After the hydrogen peroxide addition is complete, the reaction mixture is stripped at 70° C. and 20 mm Hg. The reaction mixture is filtered through diatomaceous earth to provide the desired product which is in the form of a yellow liquid.

EXAMPLE B-13

The product of Example B-11 (b) (130 grams, 0.6 equivalents) is placed in a reactor. A 34% aqueous hydrogen peroxide solution (80 grams, 0.8 moles) is added dropwise. After the hydrogen peroxide addition is complete, the reaction mixture is stripped at 70° C. and 20 mm Hg. The reaction mixture is filtered through diatomaceous earth to provide the desired product which is in the form of a yellow liquid.

EXAMPLE B-14

(a) A mixture of 317.33 grams (5.28 moles) of 2-propanol and 359.67 grams (3.52 moles) of 4-methyl-2-pentanol is prepared and heated to 60° C. Phosphorus pentasulfide (444.54 grams, 2.0 moles) is added to the alcohol mixture while maintaining the temperature at 60° C. Two moles of hydrogen sulfide are liberated and trapped with a 50% aqueous sodium hydroxide trap. The mixture is heated to and maintained at 70° C. for two hours. The mixture is cooled to room temperature and filtered through diatomaceous earth to yield a liquid green product having an acid number in the range of 193–203.

(b) 89.1 grams (1.1 moles) of ZnO are added to 200 ml of toluene. 566.6 grams (2.0 equivalents based on acid number) of the product from part (a) are added dropwise to the ZnO/toluene mixture. The resulting reaction is exothermic. The reaction mixture is stripped to 70° C. and 20 mm Hg to remove water of reaction, toluene and excess alcohol. The residue is filtered through diatomaceous earth. The filtrate, which is the desired product, is a yellow viscous liquid.

When the phosphorus compound (B) is an ammonium salt, the salt is considered as being derived from ammonia ($NH_3$) or an ammonia yielding compound such as $NH_4OH$. Other ammonia yielding compounds will readily occur to those skilled in the art.

When the phosphorus compound (B) is an amine salt, the salt may be considered as being derived from amines. The amines may be primary, secondary or tertiary amines, or mixtures thereof. Hydrocarbyl groups of the amines may be aliphatic, cycloaliphatic or aromatic. These include alkyl and alkenyl groups. In one embodiment the amine is an alkylamine wherein the alkyl group contains from 1 to about 24 carbon atoms.

In one embodiment, the amines are primary hydrocarbyl amines containing from about 2 to about 30, and in one embodiment about 4 to about 20 carbon atoms in the hydrocarbyl group. The hydrocarbyl group may be saturated or unsaturated. Representative examples of primary saturated amines are the alkylamines such as methylamine, n-butylamine, n-hexylamine; those known as aliphatic primary fatty amines, for example, the commercially known "Armeen" primary amines (products available from Akzo Chemicals, Chicago, Ill.). Typical fatty amines include amines such as, n-octylamine, n-dodecylamine, n-tetradecylamine, n-octadecylamine (stearylamine), octadecenylamine (oleylamine), etc. Also suitable are mixed fatty amines such as Akzo's Armeen-C, Armeen-O, Armeen-OD, Armeen-T, Armeen-HT, Armeen S and Armeen SD, all of which are fatty amines of varying purity.

In one embodiment, the amine salts of this invention are those derived from tertiary-aliphatic primary amines having from about 4 to about 30, and in one embodiment about 6 to about 24, and in one embodiment about 8 to about 24 carbon atoms in the aliphatic group.

Usually the tertiary-aliphatic primary amines are monoamines, and in one embodiment alkylamines represented by the formula

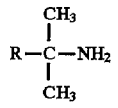

wherein R is a hydrocarbyl group containing from 1 to about 30 carbon atoms. Such amines are illustrated by tertiary-butylamine, 1-methyl-1-amino-cyclohexane, tertiary-octyl primary amine, tertiary-tetradecyl primary amine, tertiary-hexadecyl primary amine, tertiary-octadecyl primary amine, tertiary-octacosanyl primary amine.

Mixtures of tertiary alkyl primary amines are also useful for the purposes of this invention. Illustrative of amine mixtures of this type are "Primene 81R" which is a mixture of $C_{11-14}$ tertiary alkyl primary amines and "Primene JMT" which is a similar mixture of $C_{18-22}$ tertiary alkyl primary amines (both are available from Rohm and Haas). The tertiary alkyl primary amines and methods for their preparation are known to those of ordinary skill in the art. The tertiary-alkyl primary amine useful for the purposes of this invention and methods for their preparation are described in U.S. Pat. No. 2,945,749 which is hereby incorporated by reference for its teachings in this regard.

Primary amines in which the hydrocarbyl group comprises olefinic unsaturation also are useful. Thus, the hydrocarbyl groups may contain one or more olefinic unsaturation depending on the length of the chain, usually no more than one double bond per 10 carbon atoms. Representative amines are dodecenylamine, oleylamine and linoleylamine. Such unsaturated amines are available under the Armeen tradename.

Secondary amines include dialkylamines having two of the above hydrocarbyl, preferably alkyl or alkenyl groups described for primary amines including such commercial fatty secondary amines as Armeen 2C and Armeen HT, and also mixed dialkylamines wherein, for example, one alkyl group is a fatty group and the other alkyl group may be a lower alkyl group (1–7 carbon atoms) such as ethyl, butyl, etc., or the other hydrocarbyl group may be an alkyl group bearing other non-reactive or polar substituents (CN, alkyl, carbalkoxy, amide, ether, thioether, halo, sulfoxide, sulfone) such that the essentially hydrocarbon character of the group is not destroyed.

Tertiary amines such as trialkyl or trialkenyl amines and those containing a mixture of alkyl and alkenyl amines are useful. The alkyl and alkenyl groups are substantially as described above for primary and secondary amines.

Other useful primary amines are the primary etheramines represented by the formula $R''OR'NH_2$ wherein R' is a divalent alkylene group having 2 to about 6 carbon atoms and R" is a hydrocarbyl group of about 5 to about 150 carbon atoms. These primary etheramines are generally prepared by the reaction of an alcohol R"OH wherein R" is as defined hereinabove with an unsaturated nitrile. Typically, the alcohol is a linear or branched aliphatic alcohol with R" having up to about 50 carbon atoms, and in one embodiment up to about 26 carbon atoms, and in one embodiment from about 6 to about 20 carbon atoms. The nitrile reactant can have from about 2 to about 6 carbon atoms, with acrylonitrile being useful. Ether amines are commercially available under the name SURFAM marketed by Mars Chemical Company, Atlanta, Ga. Typical of such amines are those having a molecular weight of from about 150 to about 400. Useful etheramines are exemplified by those identified as SURFAM P14B (decyloxypropylamine), SURFAM P16A (linear $C_{16}$), SURFAM P17B (tridecyloxypropylamine). The hydrocarbyl chain lengths (i.e., $C_{14}$, etc.) of the SURFAM described above and used hereinafter are approximate and include the oxygen ether linkage. For example, a $C_{14}$ SURFAM amine would have the following general formula $$C_{10}H_{21}OC_3H_6NH_2$$

The amines used to form the amine salts may be hydroxyamines. In one embodiment, these hydroxyamines can be represented by the formula

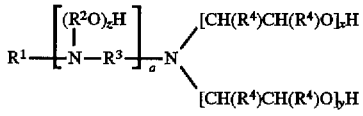

wherein $R^1$ is a hydrocarbyl group generally containing from about 6 to about 30 carbon atoms, $R^2$ is an ethylene or propylene group, $R^3$ is an alkylene group containing up to about 5 carbon atoms, a is zero or one, each $R^4$ is hydrogen or a lower alkyl group, and x, y and z are each independently integers from zero to about 10, at least one of x, y and z being at least 1. The above hydroxyamines can be prepared by techniques well known in the art, and many such hydroxyamines are commercially available. Useful hydroxyamines where in the above formula a is zero include 2-hydroxyethylhexylamine, 2-hydroxyethyloleylamine, bis (2-hydroxyethyl)hexylamine, bis(2-hydroxyethyl) oleylamine, and mixtures thereof. Also included are the comparable members wherein in the above formula at least one of x and y is at least 2.

A number of hydroxyamines wherein a is zero are available from Armak under the general trade designation "Ethomeen" and "Propomeen." Specific examples include "Ethomeen C/15" which is an ethylene oxide condensate of a coconut fatty amine containing about 5 moles of ethylene oxide; "Ethomeen C/20" and "C/25" which also are ethylene oxide condensation products from coconut fatty amine containing about 10 and 15 moles of ethylene oxide, respectively. "Propomeen O/12" is the condensation product of one mole of oleylamine with 2 moles propylene oxide.

Commercially available examples of alkoxylated amines where a is 1 include "Ethoduomeen T/13" and "T/20" which are ethylene oxide condensation products of N-tallow trimethylenediamine containing 3 and 10 moles of ethylene oxide per mole of diamine, respectively.

The fatty diamines include mono- or dialkyl, symmetrical or asymmetrical ethylenediamines, propanediamines (1,2 or 1,3) and polyamine analogs of the above. Suitable fatty polyamines such as those sold under the name Duomeen are commercially available diamines described in Product Data Bulletin No. 7-10$R_1$ of Armak. In another embodiment, the secondary amines may be cyclic amines such as piperidine, piperazine, morpholine, etc.

The following examples illustrate the preparation of amine or ammonium salts of the phosphorus compounds (B) that can be used with this invention.

EXAMPLE B-15

Phosphorus pentoxide (208 grams, 1.41 moles) is added at 50° C. to 60° C. to hydroxypropyl O,O'-diisobutylphosphorodithioate (prepared by reacting 280 grams of propylene oxide with 1184 grams of O,O'-diisobutylphosphorodithioic acid at 30° C. to 60° C.). The reaction mixture is heated to 80° C. and held at that temperature for 2 hours. To the acidic reaction mixture there is added a stoichiometrically equivalent amount (384 grams) of a commercial aliphatic primary amine at 30° C. to 60° C. The product is filtered. The filtrate has a phosphorus content of 9.31%, a sulfur content of 11.37%, a nitrogen content of 2.50%, and a base number of 6.9 (bromphenol blue indicator).

EXAMPLE B-15

To 400 parts of O,O'di-(isooctyl) phosphorodithioic acid is added 308 parts of oleylamine (Armeen O-Armak).

EXAMPLE B-17

(a) O,O-di-(2-ethylhexyl) dithiophosphoric acid (354 grams) having an acid number of 154 is introduced into a stainless steel "shaker" type autoclave of 1320 ml capacity having a thermostatically controlled heating jacket. Propylene oxide is admitted until the pressure rises to 170 psig at room temperature, and then the autoclave is sealed and shaken for 4 hours at 50° C. to 100° C. during which time the pressure rises to a maximum of 550 psig. The pressure decreases as the reaction proceeds. The autoclave is cooled to room temperature, the excess propylene oxide is vented and the contents removed. The product (358 grams), a dark liquid having an acid number of 13.4, is substantially O,O-di-(2-ethylhexyl)-S-hydroxyisopropyl dithiophosphate.

(b) Ammonia is blown into the product of part (a) until a substantially neutral product is obtained.

The phosphorus compound (B) is an optional ingredient, but when used it is employed in the inventive lubricating oil or functional fluid composition at a concentration sufficient to provide such composition with enhanced antiwear properties, and in one embodiment enhanced antioxidant properties. The concentration is generally in the range of up to about 2% by weight, and in one embodiment in the range of about 0.1% to about 2%, and in one embodiment about 0.1% to about 1.5%, and in one embodiment from about 0.1% to about 1.2%, and in one embodiment about 0.1% to about 1.1% by weight, and in one embodiment about 0.1% to about 1%, and in one embodiment about 0.1% to about 0.8% by weight, and in one embodiment about 0.1% to about 0.5% by weight based on the total weight of the lubricant or functional fluid.

In one embodiment the inventive lubricating oil and functional fluid compositions have a phosphorus content of up to about 0.12% by weight, and in one embodiment up to about 0.11% by weight, and in one embodiment up to about 0.1% by weight, and in one embodiment up to about 0.08% by weight, and in one embodiment up to about 0.05% by weight. In one embodiment the phosphorus content is in the range of about 0.01% to about 0.12% by weight, and in one embodiment about 0.01% to about 0.11% by weight, and in one embodiment about 0.01% to about 0.1% by weight, and in one embodiment about 0.01% to about 0.08% by weight, and in one embodiment about 0.01% to about 0.05% by weight based on the total weight of the lubricating oil or functional fluid composition. In one embodiment these lubricating oil and functional fluid compositions are phosphorus-free.

Additional Additives

The invention also provides for low-viscosity lubricating oils and functional fluids containing other additives in addition to component (A)and optional component (B). Such additives include, for example, detergents and dispersants, corrosion-inhibiting agents, antioxidants, viscosity improving agents, extreme pressure (E.P.) agents, pour point depressants, friction modifiers, fluidity modifiers, anti-foam agents, etc.

The inventive lubricating oil and functional fluid compositions can contain one or more detergents or dispersants of the ash-producing or ashless type. The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions and functional fluids of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in many U.S. patents including U.S. Pat. Nos. 3,219,666; 4,234,435; and 4,938,881. These include the products formed by the reaction of a polyisobutenyl succinic anhydride with an amine such as a polyethylene amine.

(2) Reaction products of relatively high molecular weight aliphatic or alicyclic halides with amines, preferably oxyalkylene polyamines. These may be characterized as "amine dispersants" and examples thereof are described for example, in the following U.S. Pat. Nos.: 3,275,554; 3,438,757; 3,454,555; and 3,565,804.

(3) Reaction products of alkyl phenols in which the alkyl group contains at least about 30 carbon atoms with aldehydes (especially formaldehyde) and amines (especially polyalkylene polyamines), which may be characterized as "Mannich dispersants." The materials described in the following U.S. patents are illustrative: U.S. Pat. Nos. 3,649,229; 3,697,574; 3,725,277; 3,725,480; 3,726,882; and 3,980,569.

(4) Products obtained by post-treating the amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos.: 3,639,242; 3,649,229; 3,649,659; 3,658,836; 3,697,574; 3,702,757; 3,703,536; 3,704,308; and 3,708,422.

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos.: 3,329,658; 3,449,250; 3,519,565; 3,666,730; 3,687,849; and 3,702,300.

The above-noted patents are incorporated by reference herein for their disclosures of ashless dispersants.

The inventive lubricating oil and functional fluid compositions can contain one or more extreme pressure, corrosion inhibitors and/or oxidation inhibitors. Extreme pressure agents and corrosion- and oxidation-inhibiting agents which may be included in the lubricants and functional fluids of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; metal thiocarbamates, such as zinc dioctyldithiocarbamate, and barium heptylphenyl dithiocarbamate; dithiocarbamate esters from the reaction product of dithiocarbamic acid and acrylic, methacrylic, maleic, fumaric or itaconic esters; dithiocarbamate containing amides prepared from dithiocarbamic acid and an acrylamide; alkylene-coupled dithiocarbamates; sulfur-coupled dithiocarbamates. Many of the above-mentioned extreme pressure agents and oxidation-inhibitors also serve as antiwear agents.

Pour point depressants are a useful type of additive often included in the lubricating oils and functional fluids described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. A specific pour point depressant that can be used is the product made by alkylating naphthalene with polychlorinated paraffin and $C_{16}$–$C_{18}$ alpha-olefin. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional antifoam compositions are described in "Foam Control Agents," by Henry T. Kerner (Noyes Data Corporation, 1976), pages 125–162.

The friction modifiers that are useful include the fatty acid amides such as oleylamide, stearylamide, linoleylamide, and the like.

Each of the foregoing additives, when used, is used at a functionally effective amount to impart the desired properties to the lubricant or functional fluid. Thus, for example, if an additive is a dispersant, a functionally effective amount of this dispersant would be an amount sufficient to impart the desired dispersancy characteristics to the lubricant or functional fluid. Similarly, if the additive is an extreme-pressure agent, a functionally effective amount of the extreme-pressure agent would be a sufficient amount to improve the extreme-pressure characteristics of the lubricant or functional fluid. Generally, the concentration of each of these additives, when used, ranges from about 0.001% to about 20% by weight, and in one embodiment about 0.01% to about 10% by weight based on the total weight of the lubricant or functional fluid.

Component (A) and optional component (B) of the inventive compositions as well as one of the other above-discussed additives or other additives known in the art can be added directly to the lubricant or functional fluid. In one embodiment, however, they are diluted with a substantially inert, normally liquid organic diluent such as mineral oil, naphtha, benzene, toluene or xylene to form an additive concentrate which is then added to the base oil to make up the lubricant or functional fluid. These concentrates usually contain from about 1% to about 99% by weight, and in one embodiment about 10% to about 90% by weight of the inventive additives (that is, component (A) and optionally component (B)) and may contain, in addition, one or more other additives known in the art or described hereinabove. The remainder of the concentrate is the substantially inert normally liquid diluent.

The following Examples 1–13 are provided for the purpose of illustrating lubricating compositions or functional fluids within the scope of the invention.

| | Wt. % |
|---|---|
| Example 1 | |
| Product of Example A-1 | 1.0 |
| Base oil | Remainder |
| Viscosity: 4 cST at 100° C. | |
| Example 2 | |
| Product of Example A-2 | 1.2 |
| Base oil | Remainder |
| Viscosity: 3.8 cST at 100° C. | |
| Example 3 | |
| Product of Example A-1 | 0.5 |
| Product of Example B-1 | 0.5 |
| Base oil | Remainder |
| Viscosity: 3.5 cST at 100° C. | |
| Example 4 | |
| Product of Example A-1 | 0.5 |
| Product of Example B-2 | 0.8 |
| Base oil | Remainder |
| Viscosity: 3.9 cST at 100° C. | |
| Example 5 | |
| Product of Example A-1 | 0.4 |
| Product of Example B-3 | 0.7 |
| Base oil | Remainder |
| Viscosity: 3 cST at 100° C. | |
| Example 6 | |
| Product of Example A-1 | 0.7 |
| Product of Example B-4 | 0.5 |
| Base oil | Remainder |
| Viscosity: 3.7 cST at 100° C. | |
| Example 7 | |
| Product of Example A-1 | 1.0 |
| Product of Example B-5 | 0.7 |
| Base oil | Remainder |
| Viscosity: 2.5 cST at 100° C. | |
| Example 8 | |
| Product of Example A-1 | 0.2 |
| Product of Example B-6 | 1.0 |
| Base oil | Remainder |
| Viscosity: 4 cST at 100° C. | |
| Example 9 | |

-continued

| | Wt. % |
|---|---|
| Product of Example A-1 | 0.5 |
| Product of Example B-8 | 0.7 |
| Base oil | Remainder |
| Viscosity: 3 cST at 100° C. | |
| Example 10 | |
| Product of Example A-2 | 1.2 |
| Product of Example B-8 | 0.3 |
| Base oil | Remainder |
| Viscosity: 3.2 cST at 100° C. | |
| Example 11 | |
| Product of Example A-1 | 0.8 |
| Product of Example B-14 | 0.1 |
| Base oil | Remainder |
| Viscosity: 3.1 cST at 100° C. | |
| Example 12 | |
| Product of Example A-2 | 0.5 |
| Product of Example B-8 | 1.0 |
| Base oil | Remainder |
| Viscosity: 3.6 cST at 100° C. | |
| Example 13 | |
| Product of Example A-1 | 0.5 |
| Product of Example A-2 | 0.3 |
| Product of Example B-14 | 0.5 |
| Base oil | Remainder |
| Viscosity: 3.7 cST at 100° C. | |

Examples 14 and 15 are provided in Table I for the purpose of further illustrating the invention. In Table I, all numerical values, except for the concentration of the silicone antifoam agent, are expressed in percent by weight. The concentration of the silicone antifoam agent is expressed in parts per million, ppm.

TABLE I

| Example No. | 14 | 15 |
|---|---|---|
| Base oil (89% 100 N oil + 11% 150 N oil) | 79.55 | 82.25 |
| SAE Viscosity Grade | 5W-30 | 5W-30 |
| Product of Example A-1 | 0.25 | 0.25 |
| Product of Example B-14 | 1.2 | 0.7 |
| Shellvis 260 (radial polyisoprene VI improver) | 0.7 | — |
| 100 N hydrofinished mineral oil | 6.3 | — |
| ECA 7955 (product of Exxon identified as a dialkyl fumarate-vinyl acetate copolymer pour point depressant) | 0.2 | — |
| Reaction product of polyisobutenyl succinic anhydride and ethylene polyamine | 3 | 1.8 |
| Diluent oil | 6.3 | 11.7 |
| Vegetable oil | 0.2 | — |
| Alkylated diphenylamine | 0.3 | 0.5 |
| Hindered alkylated phenol | 0.8 | — |
| Calcium overbased sulfur coupled alkylphenol | 0.2 | 0.3 |
| Calcium overbased sulfonate (metal to sulfonate ratio of 1.2) | 0.4 | 0.1 |
| Magnesium overbased sulfonate (metal to sulfonate ratio of 14.7) | 0.1 | 0.3 |
| Sodium overbased alkenyl succinate | 0.4 | 0.1 |
| Oleylamide | 0.1 | — |
| Partially esterified polyisobutenyl succinic anhydride post-treated with polyethylene amines | — | 0.8 |
| Sulfur monochloride reacted with alpha olefins followed by contact with sodium disulfide | — | 0.3 |

TABLE I-continued

| Example No. | 14 | 15 |
|---|---|---|
| Olefin copolymer VI improver | — | 0.7 |
| Viscoplex 1-330 (product of Rohm GmbH identified as a polymethacrylate pour point depressant) | — | 0.2 |
| Silicone antifoam agent, ppm | 18 | 18 |

Examples 16 and 16-C are formulated for the purpose of providing test comparisons using the ASTM Sequence VE Engine Test. Examples 16 and 16-C are conventional fully formulated engine lubricating oil compositions which are identical except for the fact that Example 16 contains 0.25% by weight of the product of Example A-1 and 0.7% by weight of the product of Example B-14, while Example 16-C contains only 0.7% by weight of the product of Example B-14.

The ASTM Sequence VE Engine Test is conducted using a 2.3 L, four-cylinder, overhead cam, fuel injected engine. The test is a cyclic test conducted for a period of 288 hours. There are 72 cycles, each being four hours in length and having three stages. The length of time and operating conditions for each stage are as follows:

| Engine Conditions | Stage I | Stage II | Stage III |
|---|---|---|---|
| Time (min) | 120 | 75 | 45 |
| Speed (rpm) | 2500 | 2500 | 750 |
| Load (kW) | 25 | 25 | 0.75 |
| Oil Temp. (°C.) | 68 | 99 | 46 |

At the end of 288 hours the engine is disassembled and selected parts are rated for wear. The test results are reported in Table II below. In Table II, all numerical values are in mils of wear.

TABLE II

| Example No. | 16 | 16-C |
|---|---|---|
| Max. Cam Lobe Wear, mils | 13.8 | 15.5 |
| Avg. Cam Lobe Wear, mils | 2.02 | 10.5 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A low-viscosity engine lubricating oil composition, said composition being characterized by a phosphorus content of about 0.01% to about 0.1% by weight and comprising: a major amount of an oil having a kinematic viscosity of up to about 4 cST at 100° C.; and a minor antiwear amount of (A) a compound represented by the formula $$R^1R^2N—C(X)S—(CR^3R^4)_aZ \quad \text{(A-I)}$$

wherein in Formula (A-I), $R^1$, $R^2$, $R^3$ and $R^4$ are independently hydrogen or hydrocarbyl groups, provided that at least one of $R^1$ and $R^2$ is a hydrocarbyl group; X is O or S; a is zero, 1 or 2; and Z is a hydrocarbyl group, a hetero group, a hydroxy hydrocarbyl group, an activating group, or a $-(S)_bC(X)NR^1R^2$ group wherein b is zero, 1 or 2; provide that when a is 2, Z is an activating group; and when a is zero, Z can be an ammonium, amine or metal cation.

2. The composition of claim 1 wherein said lubricating composition has an SAE Viscosity Grade of 0W, 0W-20, 0W-30, 0W-40, 0W-50, 0W-60, 5W, 5W-20, 5W-30, 5W-40, 5W-50 or 5W-60.

3. The composition of claim 1 wherein $R^1$ and $R^2$ are independently aliphatic hydrocarbyl groups of 1 to about 30 carbon atoms.

4. The composition of claim 1 wherein X is S.

5. The composition of claim 1 wherein in Formula (A-I), Z is a carboxylic acid or ester group, a sulfonic acid or ester group, a sulfinic acid or ester group, a phosphonic acid or ester group, a phosphinic acid or ester group, an amide group, an ether group, a carbonyl group, or a cyano group.

6. The composition of claim 1 wherein a is zero, and Z is $-C(S)-NR^1R^2$, $-SC(S)-NR^1R^2$ or $-SSC(S)-NR^1R^2$.

7. The composition of claim 1 wherein (A) is a compound represented by the formula $$R^1R^2N-\overset{\overset{\displaystyle S}{\|}}{C}-S-CH_2CH_2-\overset{\overset{\displaystyle O}{\|}}{C}-OR^5 \qquad \text{(A-V)}$$

wherein in Formula (A-V), $R^1$, $R^2$ and $R^5$ are independently hydrocarbyl groups.

8. The composition of claim 1 wherein (A) is a compound represented by the formula $$(C_4H_9)_2N-\overset{\overset{\displaystyle S}{\|}}{C}-S-CH_2CH_2-\overset{\overset{\displaystyle O}{\|}}{C}-OCH_3 \qquad \text{(A-VI)}$$

9. The composition of claim 1 wherein (A) is a compound represented by the formula $$R^1R^2N-\overset{\overset{\displaystyle X}{\|}}{C}S-\overset{\overset{\displaystyle X}{\|}}{S}C-NR^1R^2 \qquad \text{(A-VII)}$$

wherein in Formula (A-VII), $R^1$ and $R^2$ are independently hydrocarbyl groups, and X is O or S.

10. The composition of claim 1 wherein (A) is a compound represented by the formula $$R^1R^2N-\overset{\overset{\displaystyle S}{\|}}{C}S-\overset{\overset{\displaystyle S}{\|}}{S}C-NR^1R^2 \qquad \text{(A-VIII)}$$

wherein in Formula (A-VIII), $R^1$ and $R^2$ are independently aliphatic hydrocarbyl groups.

11. The composition of claim 1 further comprising:

(B) a phosphorus compound.

12. The composition of claim 11 wherein (B) is a phosphorus acid, phosphorus acid ester, phosphorus acid salt, or derivative thereof.

13. The composition of claim 11 wherein (B) is a phosphoric acid, phosphonic acid, phosphinic acid, monothiophosphoric acid, dithiophosphoric acid, thiophosphinic acid or thiophosphonic acid.

14. The composition of claim 11 wherein (B) is a phosphorus acid ester derived from a phosphorus acid or anhydride and an alcohol of 1 to about 50 carbon atoms.

15. The composition of claim 11 wherein (B) is a phosphite, a monothiophosphate, a dithiophosphate, or a dialkylthiophosphoryl disulfide.

16. The composition of claim 11 wherein (B) is a metal, amine or ammonium salt.

17. The composition of claim 11 wherein (B) is a phosphorus containing amide or a phosphorus-containing carboxylic ester.

18. The composition of claim 11 wherein (B) is a compound represented by the formula $$\begin{matrix} R^1-(O)_a \\ R^2-(O)_b \\ R^3-(O)_c \end{matrix}\!\!>P=X \qquad \text{(B-I)}$$

wherein in Formula (B-I), $R^1$, $R^2$ and $R^3$ are independently hydrogen or hydrocarbyl groups, X is O or S, and a, b and c are independently zero or 1.

19. The composition of claim 11 wherein (B) is a compound represented by the formula $$\begin{matrix} R^1-(O)_a \\ R^2-(O)_b \\ R^3-(O)_c \end{matrix}\!\!>P \qquad \text{(B-II)}$$

wherein in Formula (B-II), $R^1$, $R^2$ and $R^3$ are independently hydrogen or hydrocarbyl groups, and a, b and c are independently zero or 1.

20. The composition of claim 11 wherein (B) is a compound represented by the formula $$\begin{matrix} R^1(X^1)_a \\ R^2(X^2)_b \end{matrix}\!\!>\overset{\overset{\displaystyle X^3}{\|}}{P}-X^4R^3 \qquad \text{(B-III)}$$

wherein in Formula (B-III): $X^1$, $X^2$ and $X^3$ and $X^4$ are independently O or S, and $X^1$ and $X^2$ can be $NR^4$; a and b are independently zero or 1; and $R^1$, $R^2$, $R^3$ and $R^4$ are independently hydrocarbyl groups, and $R^3$ and $R^4$ can be hydrogen; or a metal, amine or ammonium salt of said compound.

21. The composition of claim 11 wherein (B) is a compound represented by the formula $$\begin{matrix} R^1O-\overset{\overset{\displaystyle X^1}{\|}}{P}-S-(S)_n-\overset{\overset{\displaystyle X^2}{\|}}{P}-OR^3 \\ R^2O \qquad\qquad\qquad OR^4 \end{matrix} \qquad \text{(B-IV)}$$

wherein in Formula (B-IV), $R^1$, $R^2$, $R^3$ and $R^4$ are independently hydrocarbyl groups, $X^1$ and $X^2$ are independently O or S, and n is zero to 3.

22. The composition of claim 1 further comprising a corrosion-inhibiting agent, detergent, dispersant, antioxidant, viscosity improving agent, antiwear agent, extreme-pressure agent, pour-point depressant, friction-modifier, fluidity-modifier, anti-foam agent, or mixture of two or more thereof.

23. A low-viscosity engine lubricating oil composition, said composition being characterized by a phosphorus content of about 0.01% to about 0.1% by weight and comprising: a major amount of an oil having a kinematic viscosity of up to about 4 cST at 100° C.; and a minor antiwear amount of (A) a compound represented by the formula $$(C_4H_9)_2N-\overset{\overset{\displaystyle S}{\|}}{C}-S-CH_2CH_2-\overset{\overset{\displaystyle O}{\|}}{C}-OCH_3.$$

24. A low-viscosity engine lubricating oil composition, said composition being characterized by a phosphorus content of about 0.01% to about 0.08% by weight and comprising: a major amount of an oil having a kinematic viscosity of up to about 4 cST at 100° C.; and a minor antiwear amount of (A) a compound represented by the formula $$(C_4H_9)_2N-\overset{\overset{\displaystyle S}{\|}}{C}-S-CH_2CH_2-\overset{\overset{\displaystyle O}{\|}}{C}-OCH_3$$

and (B) a phosphorus compound.

25. A low-viscosity engine lubricating oil composition, said composition being characterized by a phosphorus content of about 0.01% to about 0.1% by weight and comprising: a major amount of an oil having a kinematic viscosity of up to about 4 cST at 100° C.; and a minor antiwear amount of (A) a compound represented by the formula $$R^1R^2N-\overset{\overset{\displaystyle X}{\|}}{C}S-\overset{\overset{\displaystyle X}{\|}}{S}C-NR^1R^2 \qquad \text{(A-VII)}$$

wherein in Formula (A-VII), $R^1$ and $R^2$ are independently hydrocarbyl groups, and X is O or S.

26. A low-viscosity engine lubricating oil composition, said composition being characterized by a phosphorus content of about 0.01% to about 0.1% by weight and comprising: a major amount of an oil having a kinematic viscosity of up to about 4 cST at 100° C.; and a minor antiwear amount of (A) a compound represented by the formula $$R^1R^2N-\overset{\overset{\displaystyle X}{\|}}{C}S-\overset{\overset{\displaystyle X}{\|}}{S}C-NR^1R^2 \qquad \text{(A-VII)}$$

wherein in Formula (A-VII), $R^1$ and $R^2$ are independently hydrocarbyl groups, and X is O or S, and (B) a phosphorus compound.

27. A process for making an engine lubricating oil composition characterized by enhanced antiwear properties, comprising: mixing an oil having a kinematic viscosity of up to about 4 cST at 100° C.; and (A) a compound represented by the formula $$R^1R^2N-C(X)S-(CR^3R^4)_aZ \qquad \text{(A-I)}$$

wherein in Formula (A-I), $R^1$, $R^2$, $R^3$ and $R^4$ are independently hydrogen or hydrocarbyl groups, provided that at least one of $R^1$ and $R^2$ is a hydrocarbyl group; X is O or S; a is zero, 1 or 2; and Z is a hydrocarbyl group, a hetero group, a hydroxy hydrocarbyl group, an activating group, or a $-(S)_bC(X)NR^1R^2$ group wherein b is zero, 1 or 2; provide that when a is 2, Z is an activating group; and when a is zero, Z can be an ammonium, amine or metal cation; said oil composition being characterized by a phosphorus content of about 0.01% to about 0.1% by weight.

28. A process for making an engine lubricating oil composition characterized by enhanced antiwear properties, comprising: mixing an oil having a kinematic viscosity of up to about 4 cST at 100° C.; and (A) a compound represented by the formula $$(C_4H_9)_2N-\overset{\overset{\displaystyle S}{\|}}{C}-S-CH_2CH_2-\overset{\overset{\displaystyle O}{\|}}{C}-OCH_3$$

said oil composition being characterized by a phosphorus content of about 0.01% to about 0.1% by weight.

29. A process for making an engine lubricating oil composition characterized by enhanced antiwear properties, comprising: mixing an oil having a kinematic viscosity of up to about 4 cST at 100° C.; and (A) a compound represented by the formula $$R^1R^2N-\overset{\overset{\displaystyle X}{\|}}{C}S-\overset{\overset{\displaystyle X}{\|}}{S}C-NR^1R^2 \qquad \text{(A-VII)}$$

wherein in Formula (A-VII), $R^1$ and $R^2$ are independently hydrocarbyl groups, and X is O or S; said oil composition being characterized by a phosphorus content of about 0.01% to about 0.1% by weight.

* * * * *